US006805678B2

(12) United States Patent
Cafaro

(10) Patent No.: US 6,805,678 B2
(45) Date of Patent: Oct. 19, 2004

(54) APPARATUS FOR FOOT THERAPY

(75) Inventor: Michael Cafaro, El Paso, TX (US)

(73) Assignee: Helen of Troy, El Paso, TX (US)

( * ) Notice: Subject to any disclaimer, the term of this patent is extended or adjusted under 35 U.S.C. 154(b) by 56 days.

(21) Appl. No.: 10/036,142

(22) Filed: Dec. 26, 2001

(65) Prior Publication Data

US 2003/0120184 A1 Jun. 26, 2003

(51) Int. Cl.[7] ..... A61H 35/00

(52) U.S. Cl. ..... 601/16; 601/17; 601/22; 601/158; 4/535; 4/574.1; 4/622; 607/84; 607/86

(58) Field of Search ..... 601/16–22, 154, 601/156–160; 4/524, 525, 535, 545, 546, 574.1, 570, 591, 622; 607/84, 86

(56) References Cited

U.S. PATENT DOCUMENTS 3,837,334 A 9/1974 Johnson
3,845,759 A * 11/1974 Miklovic ..... 601/157
4,165,737 A * 8/1979 Chapa ..... 601/19
4,523,580 A 6/1985 Tureaud
4,620,529 A 11/1986 Kurosawa
4,807,602 A 2/1989 Scarborough
5,167,225 A * 12/1992 Cheng-I ..... 601/112
5,588,161 A * 12/1996 Barradas ..... 601/154
5,989,203 A * 11/1999 Wang ..... 601/15
6,339,854 B1 * 1/2002 Amendt ..... 4/524
6,393,633 B2 * 5/2002 Ferber ..... 4/622
6,405,390 B2 * 6/2002 Kuen ..... 4/622
6,438,768 B1 * 8/2002 Yen ..... 4/622
6,505,358 B2 * 1/2003 Ferber et al. ..... 4/622
6,568,000 B1 * 5/2003 Kaufman et al. ..... 4/622

* cited by examiner

*Primary Examiner*—Danton D. DeMille
(74) *Attorney, Agent, or Firm*—John E. Toupal; Harold G. Jarcho

(57) ABSTRACT

A foot treating apparatus comprising a basin that is adapted for accepting and containing bathing water and is shaped and arranged to accommodate two human feet within the bathing water. A steam generator is included and adapted to accept and contain steamable water, to convert the steamable water into steam, and to direct the steam through a steam vent disposed above the bathing water and at one or both of the soles of those feet when the feet are removed from the bathing water. Dry massage means, heating means, vibration, and aeration are also provided.

11 Claims, 8 Drawing Sheets

APPARATUS FOR FOOT THERAPY

BACKGROUND OF THE INVENTION

The present invention is an apparatus for bathing human feet while providing massage, heat, aeration and steam therapy. More particularly, the present invention relates to a portable footbath capable of providing various combinations of massage, heat and aeration for the feet, with the optional feature of selectively applying steam therapy directly to the soles of the feet.

The prior art includes numerous footbaths, which are capable of providing either a vibrating foot massage alone or a vibrating foot massage with supplemental heat and aeration. Numerous such devices additionally provide water jets for directing a water spray at the upper surfaces of the feet. Yet it is the soles of the feet that are found to be most in need of therapeutic treatment, and especially of such treatment including the application of steam. Steam applied to the soles of the feet, especially in combination with the soaking effects of the bath and the effects of massage is found to soften calluses and to help remove dead skin, while invigorating the muscles and live skin of the soles, and while reducing overall foot pain. Of all of the parts of the foot, it is the sole that takes most benefit from therapeutic treatment. For example, the sole contains many of the vital points that are addressed by acupuncture due to their close relationship with various organs. It is well documented that stimulation of these vital points reduces fatigue and revitalizes those organs.

To date, numerous complicated and expensive foot bathing and treating devices have been offered which bathe and massage the feet, but none have provided for the selected combination of bathing, massage, heat, aeration and steam, especially with the optional application of steam directed to the soles.

OBJECTS OF TIE INVENTION

It is an object of the present invention to provide an apparatus for the therapeutic treatment of human feet.

It is a further object to provide such an apparatus that renders such treatment by soaking the foot in water and subjecting the feet to heat, massage, aeration and steam therapy.

It is a further object to provide such an apparatus that allows the user to select various combinations of these therapies.

It is a further object of the present invention to provide an apparatus for the therapeutic treatment of the soles of human feet.

It is a further object to provide such an apparatus that renders such treatment by soaking the sole in water and subjecting the sole to heat, massage, aeration and steam therapy.

It is a further object to provide such an apparatus that allows the user to select various combinations of these therapies.

It is a further object to provide any or all of these benefits in an apparatus that is compact and portable, while being simple and inexpensive to manufacture.

SUMMARY OF THE INVENTION

The present invention comprises a basin into which one sets his feet. The basin includes an open top portion and a closed bottom portion that is to be partially filled with enough water to partially immerse the feet. Numerous roll-massaging elements are provided for manually treating the soles of the feet, and massage may be provided to the feet independently by means of a vibrator. The water is intended to be hot when initially added to the basin, but supplemental heating means are provided for further heating and temperature maintenance. Aeration may be applied by means of an independent pump. With the optional addition of water to a steam generator, steam is applied directly to the soles of the feet. This steam application can be done in combination with any or all of the other therapies.

BRIEF DESCRIPTION OF THE DRAWINGS

The advantages and features of the foot treating apparatus of the present invention will be more fully understood from the following description of the preferred embodiment, taken in conjunction with the accompanying drawings, wherein.

DESCRIPTION OF THE PREFERRED EMBODIMENTS

Figure 1:
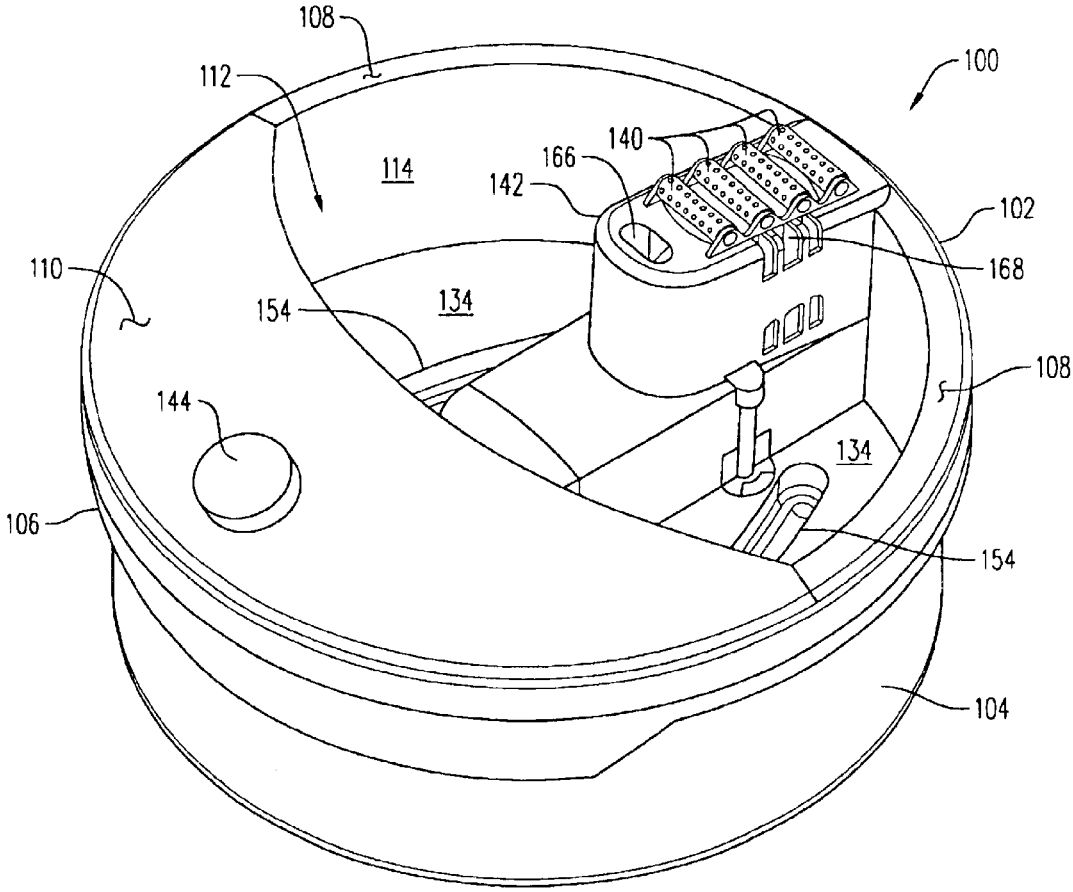
FIG. 1 is an isometric view of a foot treating apparatus in accordance with the preferred embodiment of the invention.
Figure 2:
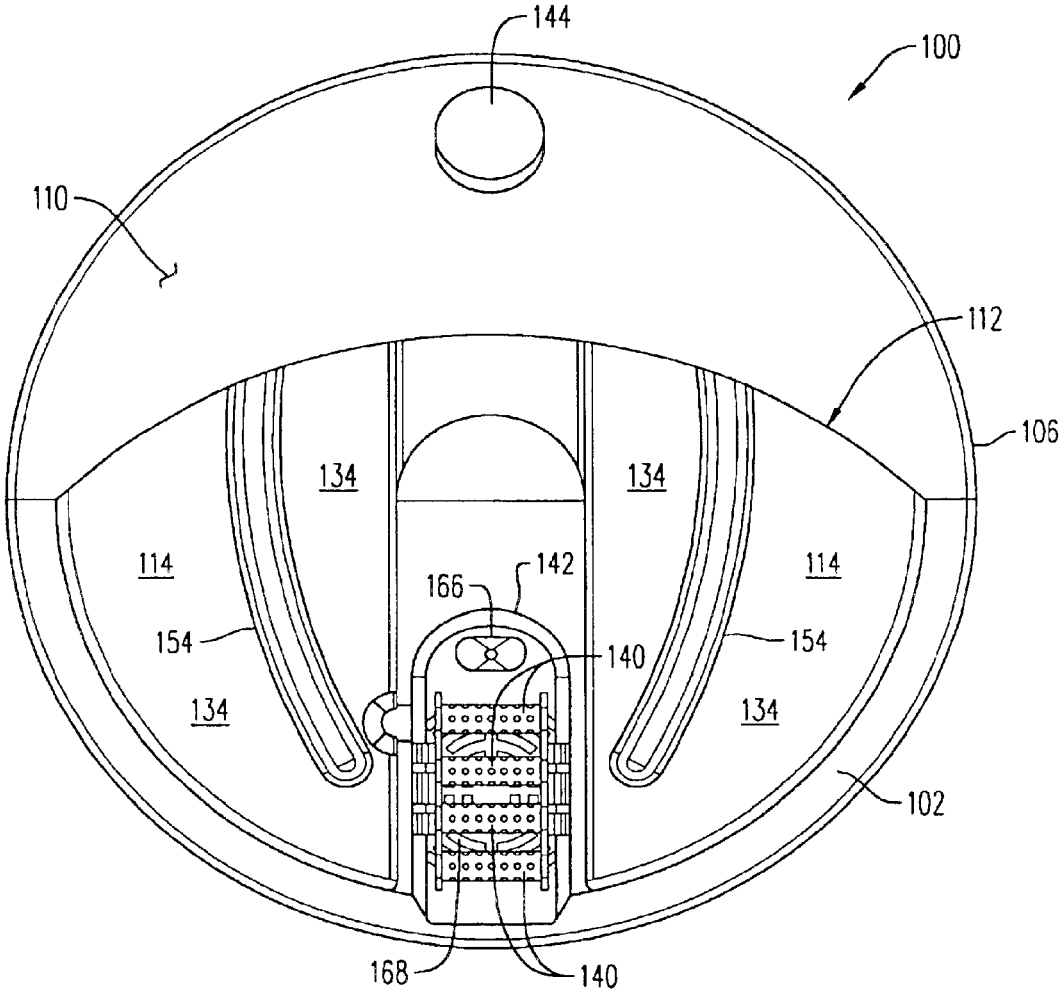
FIG. 2 is a top view thereof.
Figure 3:
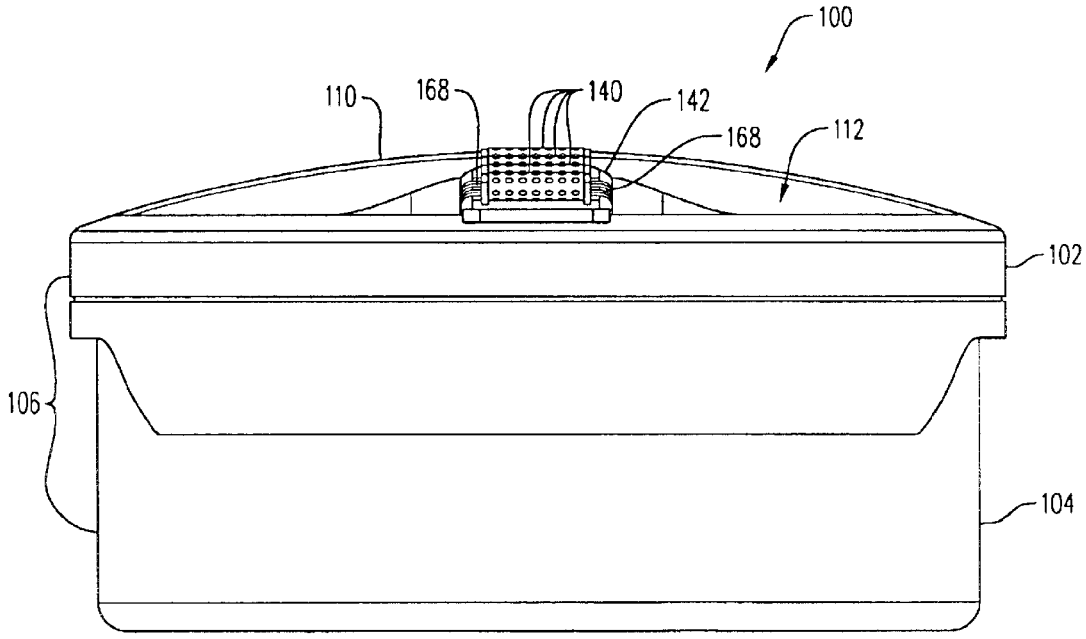
FIG. 3 is a front view thereof.
Figure 4:
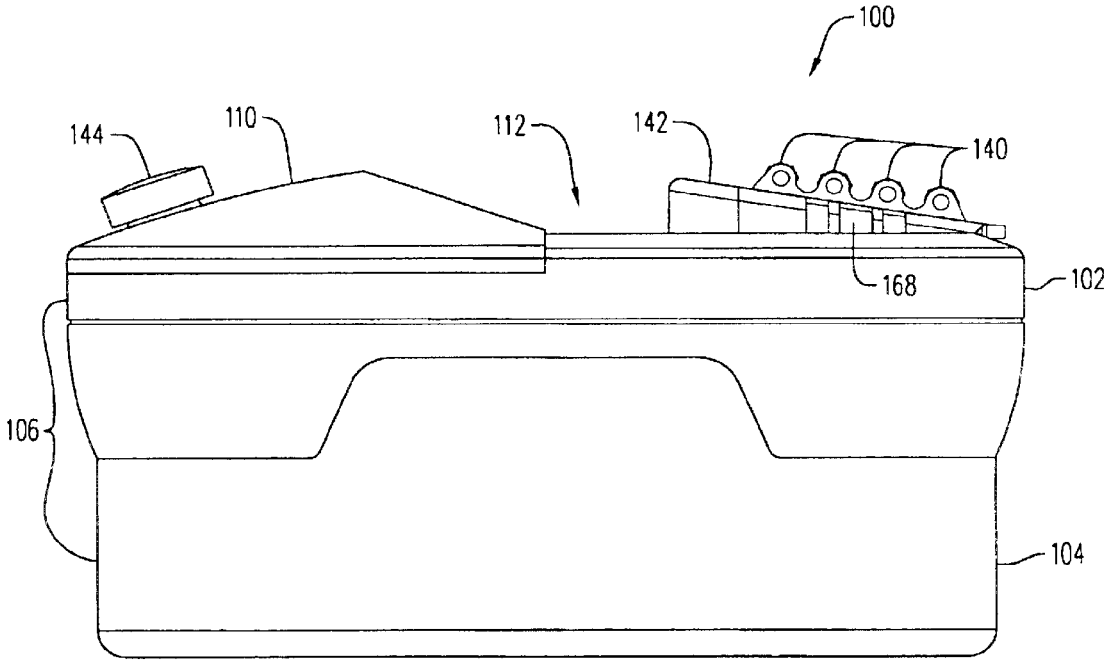
FIG. 4 is a side view thereof.
Figure 5:
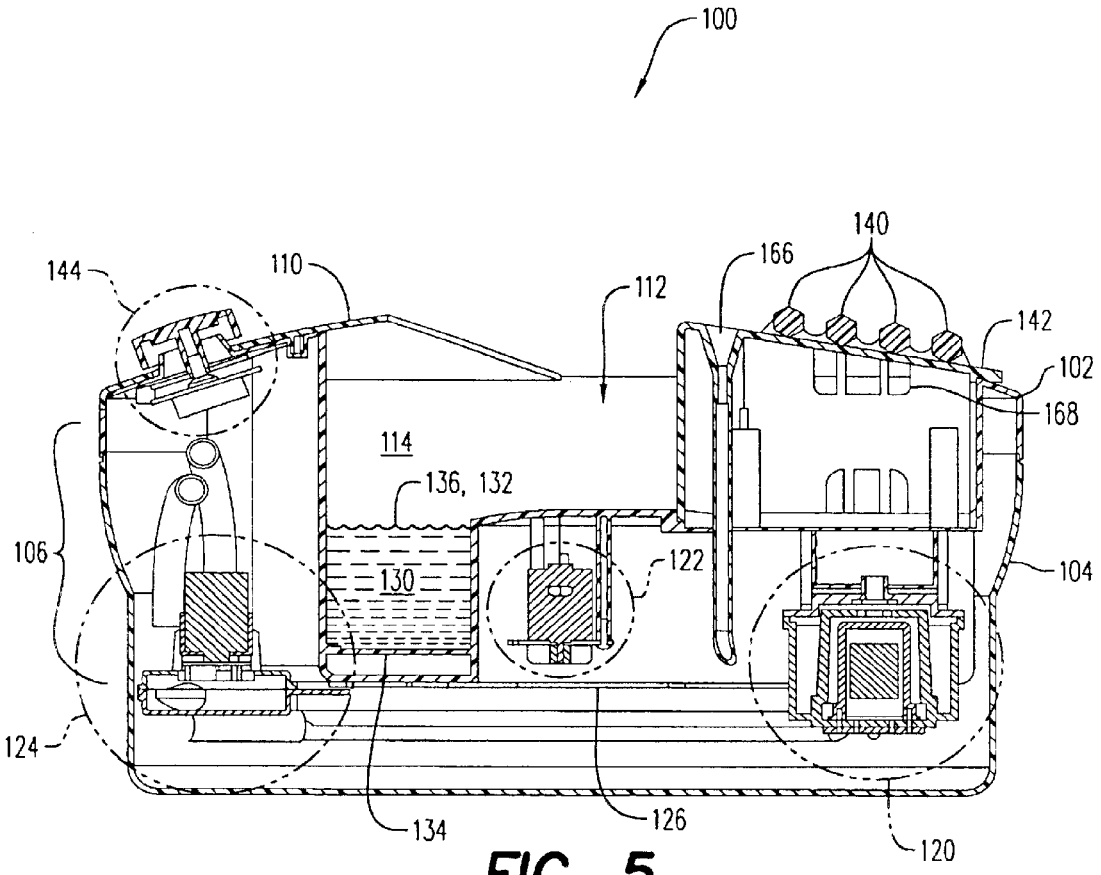
FIG. 5 is a cross-sectional side view thereof.
Figure 6:
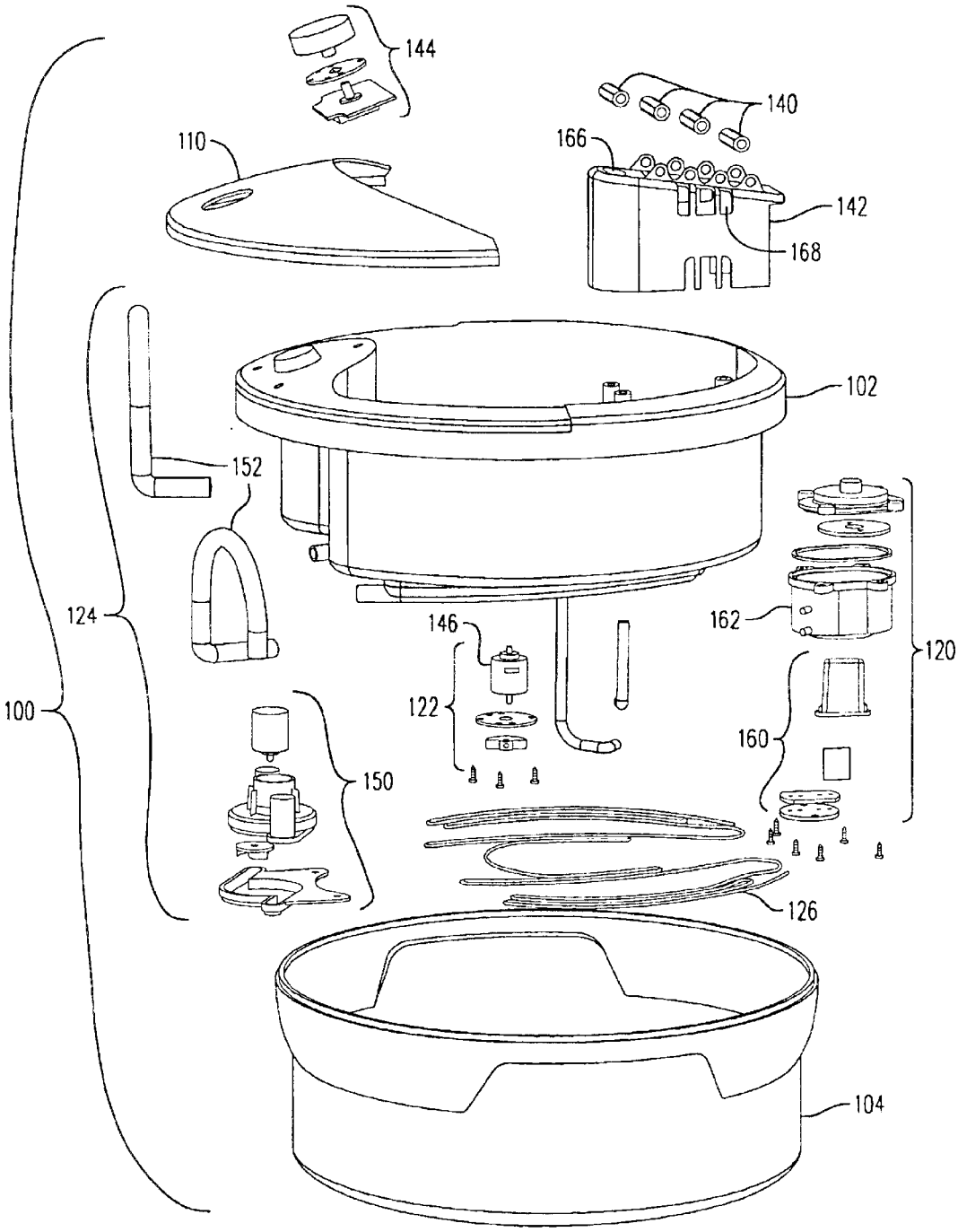
FIG. 6 is an exploded isometric view showing the unassembled components thereof.
Figure 7:
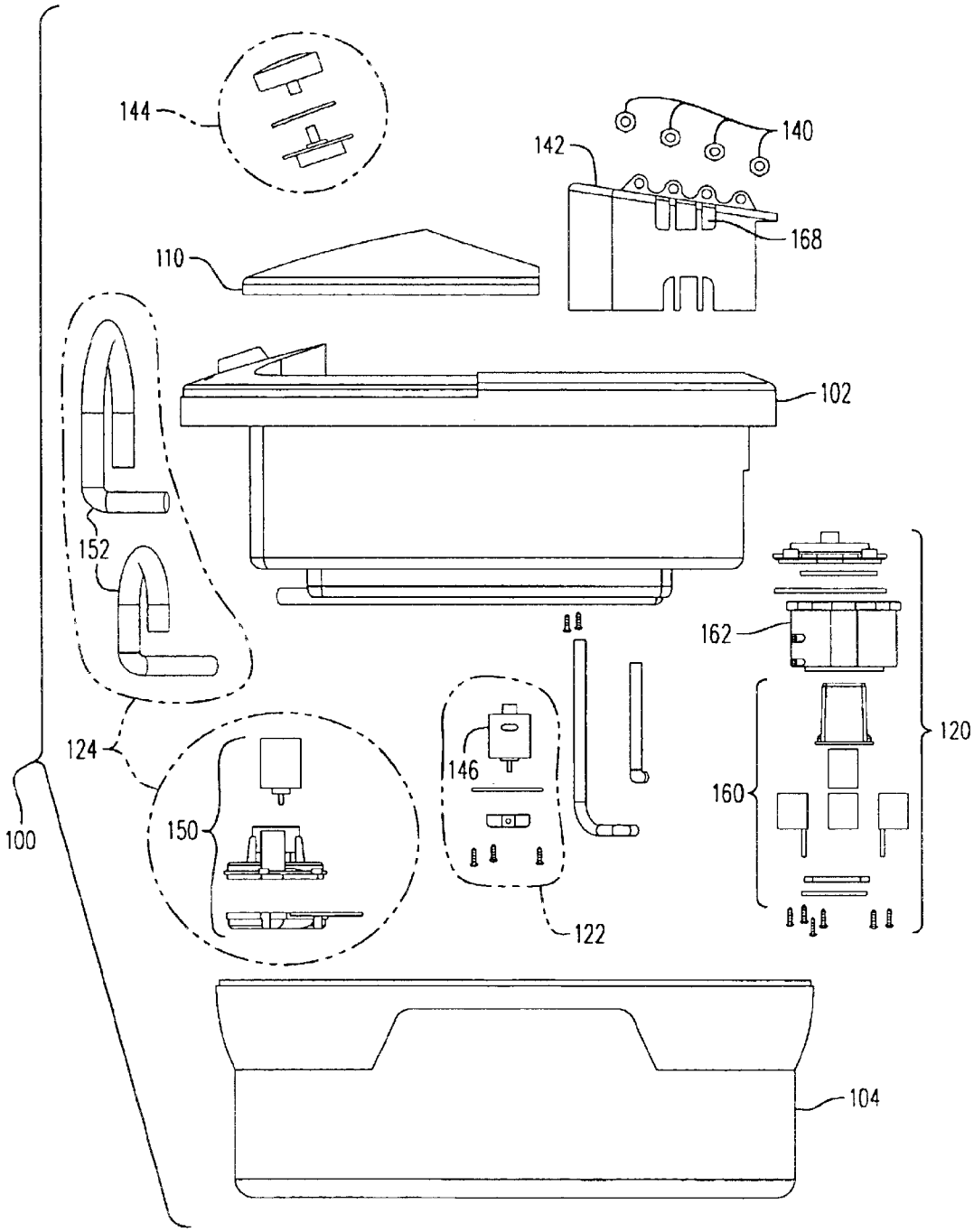
FIG. 7 is an exploded side view showing the unassembled components thereof.
Figure 8:
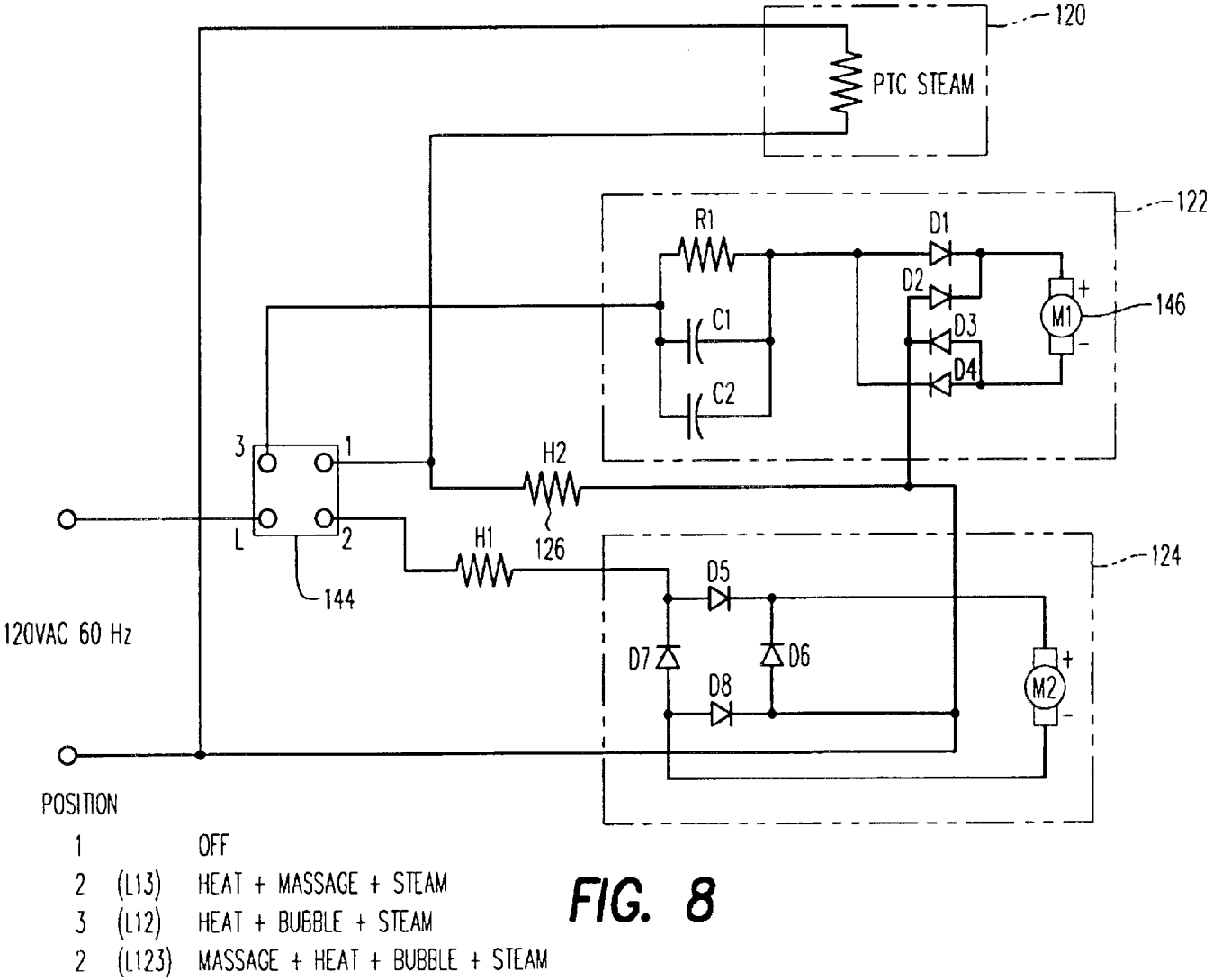
FIG. 8 is a circuit diagram thereof.

The preferred embodiment is now described with reference to FIGS. 1 through 8. Footbath 100 includes tub 102 and tub base 104, which are attached to each other to form a tub housing 106.

The tub housing 106 comprises an upper rim 108, which, together with tub shroud 110 define a foot opening 112 through which one places one's feet to insert them into the interior cavity 114 of the tub 102. Within the tub housing 106 are numerous electric components including a steam generator 120, a vibrator 122, an aerator 124, and a heater 126.

Preferably hot water 130 is poured into the interior cavity 114 of the tub 102 to fill-line 132. Once inserted through foot opening 112 and into the water 130, the soles of one's feet are rested on the bottom surface 134 of the tub's interior cavity 114, thus raising the operating water level 136 above fill-line 132.

Dry-massage rollers 140 are disposed on footrest 142, which one can use to massage the soles by running the soles back and forth there against while applying downward pressure. As well as providing expected comfort to the soles, these rollers are found to have a beneficial effect of loosening dead skin from the soles of soaked feet. Although these rollers are found to be preferable, other dry-massaging means from the art may be substituted therefore, provided that the substituted means are capable of providing stimulation to the soles while working the skin of the soles to loosen dead skin and calluses.

Switch 144 is disposed in the tub shroud 110, and is electrically connected to the electrical components within the tub housing 106 and to an external power supply (not shown). The switch has four operating positions;"Off", "Massage & Heat","Heat & Aeration", and"Massage, Heat & Aeration". In the"Massage & Heat" mode, vibrator 122 and heater 126 are energized. In the"Heat & Aeration" mode, heater 126 and aerator 124 are energized. In the"Massage, Heat & Aeration" mode, vibrator 122, heater 126, and aerator 124 are all energized. During any of these three non"Off" positions, the steam generator 120 is energized and prepared to produce steam only if water has been poured thereinto, separate from the water 130 within the tub's interior cavity 114.

Vibrator 122 includes an eccentrically imbalanced motor 146 that causes the entire tub housing 106 to vibrate when energized. This vibratory action is transmitted directly to the soles of the feet through bottom surface 134, as well as into the water 130 within the tub's interior cavity 114, causing a massaging effect to the feet entirely. There are numerous other means and methods for providing such a vibratory action to be found in the art, which may be substituted for the imbalanced motor 146 of the preferred embodiment while remaining within the scope of the invention.

Heater 126 warms bottom surface 134 from within the housing 106. This heats the soles of the feet directly, and is then conducted into and through the water 130. This not only heats the water and maintains its warmth, but also warms the feet entirely. Other heating means may be substituted from the art while remaining within the scope of the invention so long as the substitute heating means at least provides heat to the water.

Aerator 124 includes pump 150 and hosing 152. The pump forces air through the hosing 152 and from orifices 154 in bottom surface 134 where it rises as small bubbles against the soles. Although the preferred embodiment employs such an air pump, it is anticipated that a siphoning water pump could be used to recirculate the water 130 from the interior cavity 114 while siphoning air into the water before returning it to the cavity. Any similar means could be substituted from the art for injecting bubbles into the water.

Steam generator 120 is disposed under footrest 142 and includes a positive temperature coefficient (PTC) heating element 160 housed within a boiling chamber 162. Water 130 poured into the boiling chamber 162 through fill spout 166 is heated by the PTC element 160, when the switch 144 is in a non"Off" position, and is thus converted to steam, which rises through footrest 142 to steam vents 168, disposed just below the dry-massage rollers 140. By lifting the foot from the water 130 in the interior cavity 114 and placing it over the steam vents 168, one is able to steam treat the soaked sole while massaging it against the rollers 140, or simply to enjoy the soothing effect of the steam against the sole without massage. Although the PTC heating element and boiling chamber arrangement described is preferred, other means for generating steam may be substituted from the art without departing from the scope of the invention.

In addition to the heretofore unrealized comforting effect obtained by the present invention's combination of various therapeutic treatments on the soles of the feet, it is found that the combination of steam and dry-massaging on soles after they have been soaked in hot aerated water is particularly effective in removing calluses and dry skin.

While one preferred embodiment of the invention has been described, it will be understood by those skilled in the art that it is by way of example and that various changes and modifications may be made without departing from the spirit and scope of the invention, which is intended to be defined only by the appended claims.

What is claimed is:

1. A foot treating apparatus comprising:

a basin adapted for accepting and containing bathing water and shaped and arranged to accommodate two human feet submerged within the bathing water;

a footrest disposed out of the water; and a steam generator adapted to accept and contain steamable water, to convert said steamable water into steam, and having vents disposed to direct said steam at one or both of the soles of those feet while supported on said footrest.

2. The apparatus of claim 1, further comprising dry massage means disposed out of said bathing water and adapted to provide a therapeutic massage to the soles when the feet are removed from said bathing water.

3. The apparatus of claim 1, further comprising a heater adapted for providing heat to warm the feet and to increase or maintain the temperature of said bathing water.

4. The apparatus of claim 3, further comprising dry massage means disposed out of said bathing water and adapted to provide a therapeutic massage to the soles when the feet are removed from said bathing water.

5. The apparatus of claim 1, further comprising a vibrator adapted to impart a vibratory motion to said basin and said bathing water.

6. The apparatus of claim 5, further comprising a heater adapted for providing heat to warm the feet and to increase or maintain the temperature of said bathing water.

7. The apparatus of claim 6, further comprising dry massage means disposed out of said bathing water and adapted to provide a therapeutic massage to the soles when the feet are removed from said bathing water.

8. The apparatus of claim 1, further comprising an aerator adapted to inject air bubbles into said bathing water.

9. The apparatus of claim 8, further comprising a vibrator adapted to impart a vibratory motion to said basin and said bathing water.

10. The apparatus of claim 9, further comprising a heater adapted for providing heat to warm the feet and to increase or maintain the temperature of said bathing water.

11. The apparatus of claim 10, further comprising dry massage means disposed out of said bathing water and adapted to provide a therapeutic massage to the soles when the feet are removed from said bathing water.

* * * * *